US007946886B1

(12) United States Patent
Liu

(10) Patent No.: US 7,946,886 B1
(45) Date of Patent: May 24, 2011

(54) CONTACT OF COAXIAL CABLE CONNECTOR

(75) Inventor: Li-Chen Liu, Sindian (TW)

(73) Assignee: Wealleys Technologies Co., Ltd., Taipei County (TW)

( * ) Notice: Subject to any disclaimer, the term of this patent is extended or adjusted under 35 U.S.C. 154(b) by 0 days.

(21) Appl. No.: 12/644,023

(22) Filed: Dec. 22, 2009

(51) Int. Cl.
*H01R 4/24* (2006.01)

(52) U.S. Cl. ..... 439/582

(58) Field of Classification Search ..... 439/582, 439/839, 135, 578, 166, 912; 174/87, 75 C
See application file for complete search history.

(56) References Cited

U.S. PATENT DOCUMENTS 3,047,828 A * 7/1962 Gregson et al. ..... 439/248
3,480,722 A * 11/1969 Van Horssen et al. ..... 174/87
3,528,052 A * 9/1970 Brishka ..... 439/582
4,049,902 A * 9/1977 de Ronde ..... 174/359
4,261,630 A * 4/1981 Knappenberger ..... 439/135
4,708,414 A * 11/1987 Lam ..... 439/394
4,799,900 A * 1/1989 Capp et al. ..... 439/585
5,037,329 A * 8/1991 Wright ..... 439/582
5,316,499 A * 5/1994 Scannelli et al. ..... 439/534
5,494,454 A * 2/1996 Johnsen ..... 439/394
6,648,684 B2 * 11/2003 Tang ..... 439/582
6,688,916 B1 * 2/2004 Lee ..... 439/620.03
2005/0042920 A1 * 2/2005 Poiraud ..... 439/582

* cited by examiner

*Primary Examiner* — Alexander Gilman
(74) *Attorney, Agent, or Firm* — Leong C. Lei

(57) ABSTRACT

A coaxial cable connector includes a connector body, a contact chamber, a copper sleeve, and an observation window opening. A central contact bore is formed inside the observation window opening and an insulation layer is set between the central contact bore and the contact chamber. The central contact bore has a notch formed in a side thereof close to the copper sleeve to receive a core conductor of the coaxial cable to insert therein. The central contact bore also has a stop wall that prevents the core conductor from extending beyond the central contact bore. An insulation block covers the central contact bore, and a window opening bolt is set in engagement with and thus closes the observation window opening to force a projection of the insulation block to depress the core conductor to engage the central contact bore for electrical contact therebetween.

4 Claims, 8 Drawing Sheets

CONTACT OF COAXIAL CABLE CONNECTOR

(a) TECHNICAL FIELD OF THE INVENTION

The present invention generally relates to a contact of a coaxial cable connector, and more particularly to a depressed contact of a coaxial cable connector.

(b) DESCRIPTION OF THE PRIOR ART

Referring to FIGS. 1 and 1-1, which are respectively an exploded view and a cross-sectional view of a conventional coaxial cable connector, together with a coaxial cable, the conventional coaxial cable connector comprises a connector body 10, a contact chamber 11, a copper sleeve 12, an observation window opening 13, a central contact bore 14 (see FIG. 1A), and a window opening cover 15, and the coaxial cable has an core conductor 16 and an outer conductor 17. Assembling is conducted as follows. The core conductor 16 is inserted into the central contact bore 14 and is fixed thereto by soldering. The outer conductor 17 is then riveted to the copper sleeve 12. The window opening cover 15 then closes the observation window opening 13. In such an arrangement, the window opening bolt 16 can be partly exposed to get into contact with the contact chamber 1 and thus leading to shorting. Further, the observation window opening 13 provides only a very limited space, which makes the operation difficult.

Apparently, the conventional coaxial cable connector has disadvantages as follows:

(1) The assembling requires soldering, which is time consuming.

(2) Soldering operation often leads to shorting and electrical abnormality.

(3) The observation window opening is closed by the window opening cover after the soldering and thus visual inspection of the interior is prevented, making it easy to causing shorting with an undesired extension of the core conductor of the coaxial cable.

(4) The observation window opening of the conventional connector is small and a soldering iron that is used to perform soldering operation is relatively large; this makes the operation difficult and leads to high product flaw rate.

(5) Repairing of a flaw product is generally impossible and this makes the manufacturing costs very high.

In view of these problems, the present invention aims to provide an improved coaxial cable connector that overcomes the above problems.

SUMMARY OF THE INVENTION

In order to overcome the above mentioned drawbacks of the conventional coaxial cable connectors, the present invention aims to provide a coaxial cable connector that comprises a connector body, a contact chamber, a copper sleeve, and an observation window opening. A central contact bore is formed inside the observation window opening and an insulation layer is set between the central contact bore and the contact chamber. The central contact bore has a notch formed in a side thereof close to the copper sleeve to receive a core conductor of the coaxial cable to insert therein. The central contact bore also has a stop wall that prevents the core conductor from extending beyond the central contact bore. An insulation block covers the central contact bore, and a window opening bolt is set in engagement with and thus closes the observation window opening to force a projection of the insulation block to depress the core conductor to engage the central contact bore for electrical contact therebetween. The copper sleeve is then processed to secure an outer conductor of the coaxial cable therein. As such, assembling the coaxial cable in a depression manner effectively reduces product flaw rate and shortens the working hour.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 1-1 is a cross-sectional view of the conventional coaxial cable connector shown in FIG. 1 in an assembled form.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figures 1, 1A:
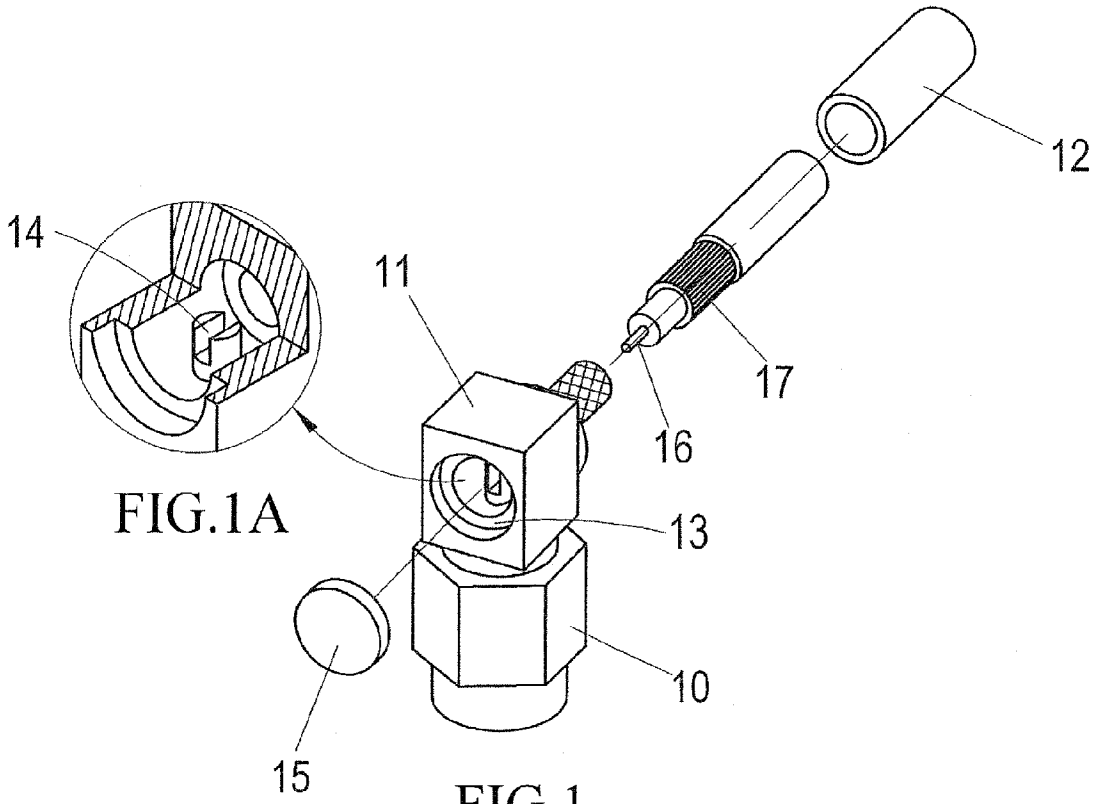
FIG.1 PRIOR ART
FIG. 1 is an exploded view of a conventional coaxial cable connector, together with a coaxial cable.
FIG. 1A is an enlarged view, partially broken, of a portion of a connector body of the conventional coaxial cable connector.
Figure 1:
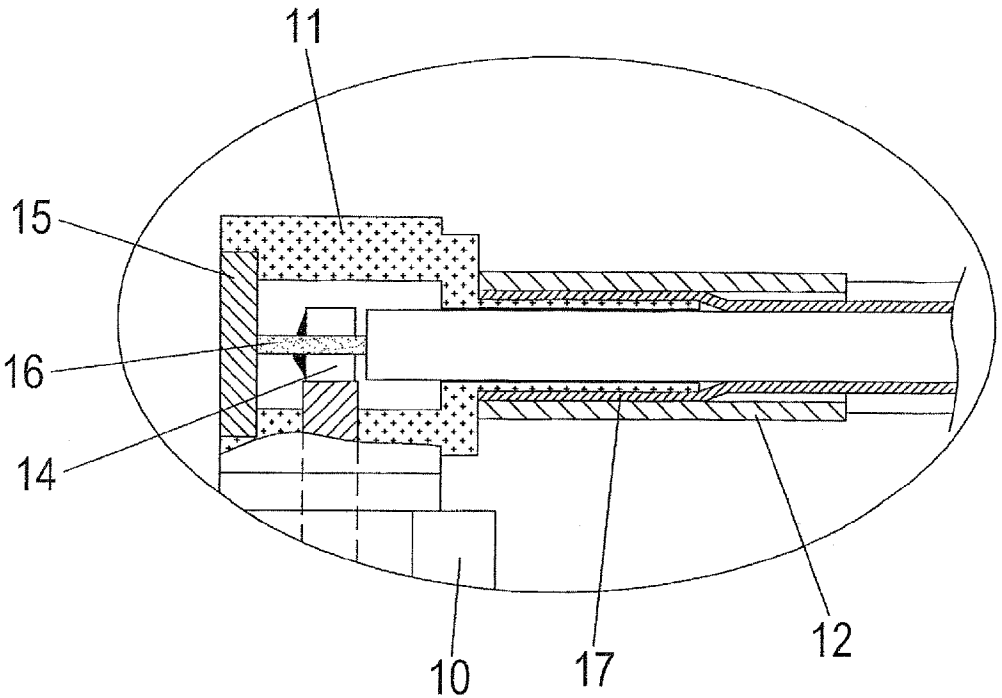
FIG.1-1 PRIOR ART
Figure 2:
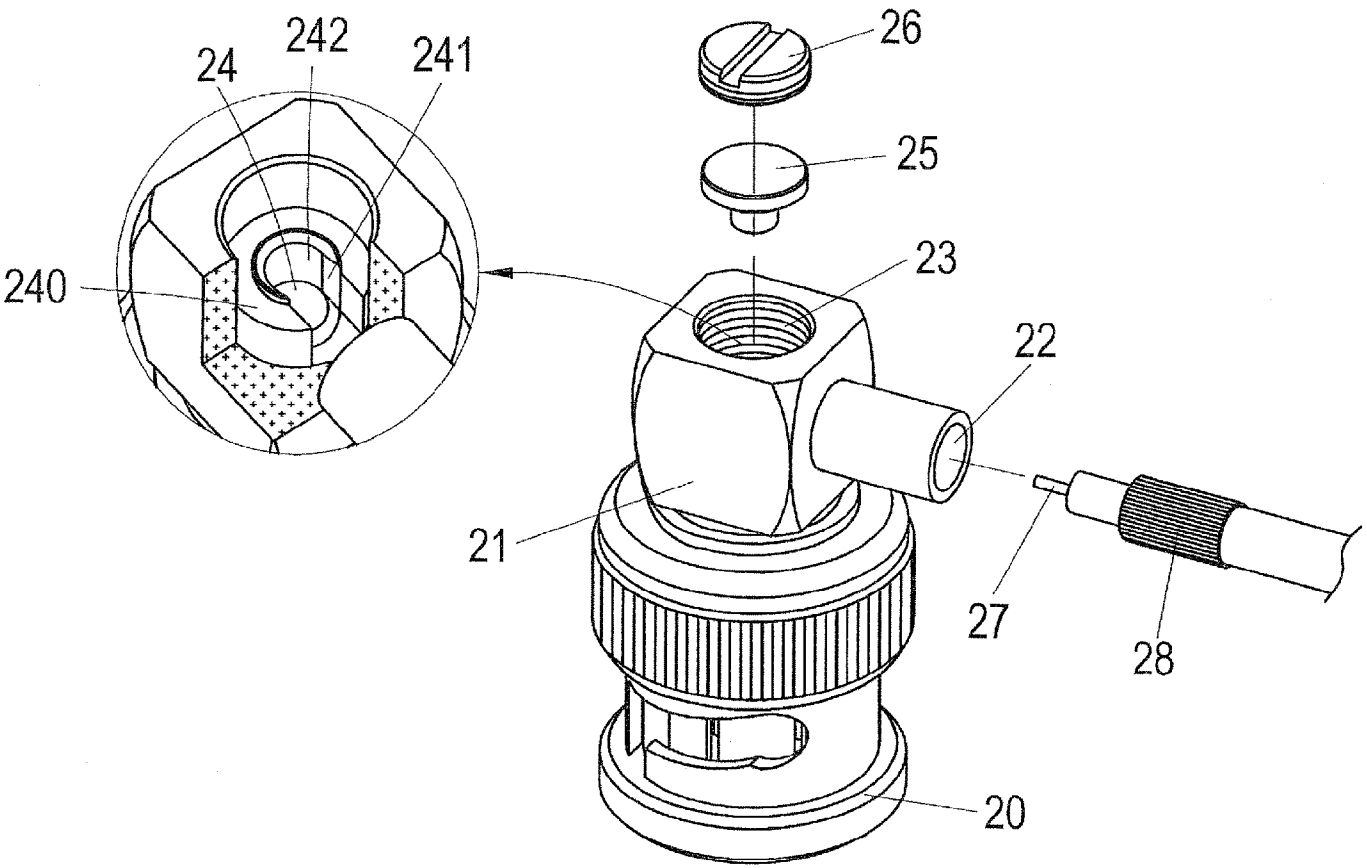
FIG. 2 is an exploded view of a coaxial cable connector according to the present invention, together with a coaxial cable.
Figure 3:
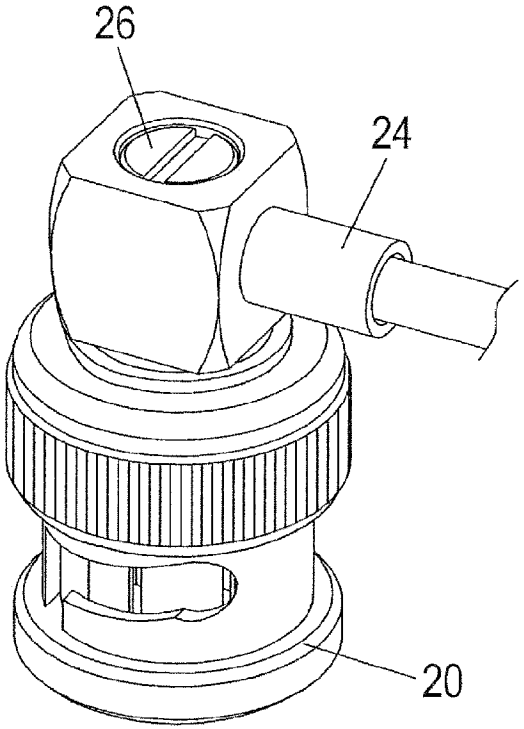
FIG. 3 is a perspective view of the coaxial cable connector according to the present invention in an assembled form.
Figure 4:
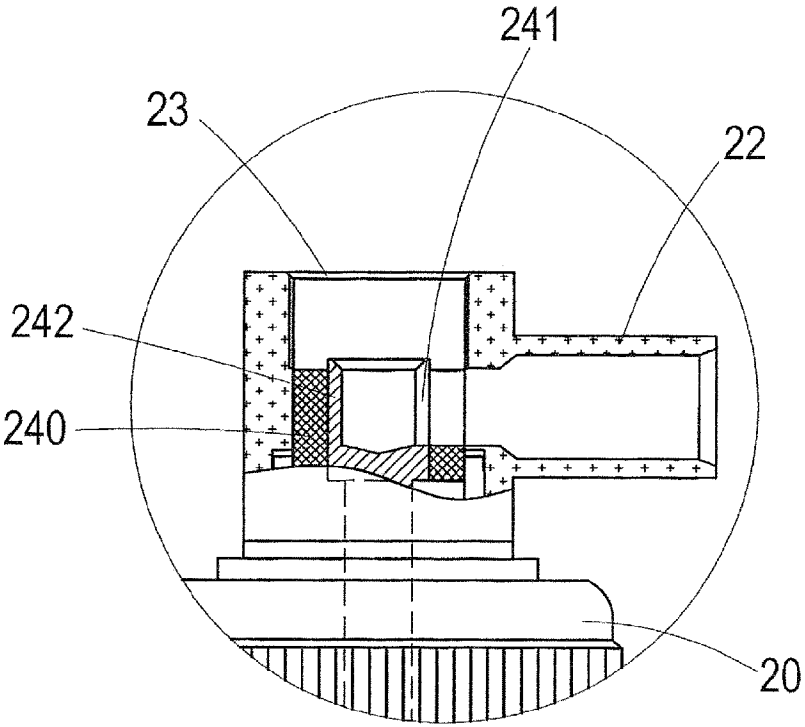
FIG. 4 is a cross-sectional view illustrating a first phase of assembling the coaxial cable connector according to the present invention.
Figure 5:
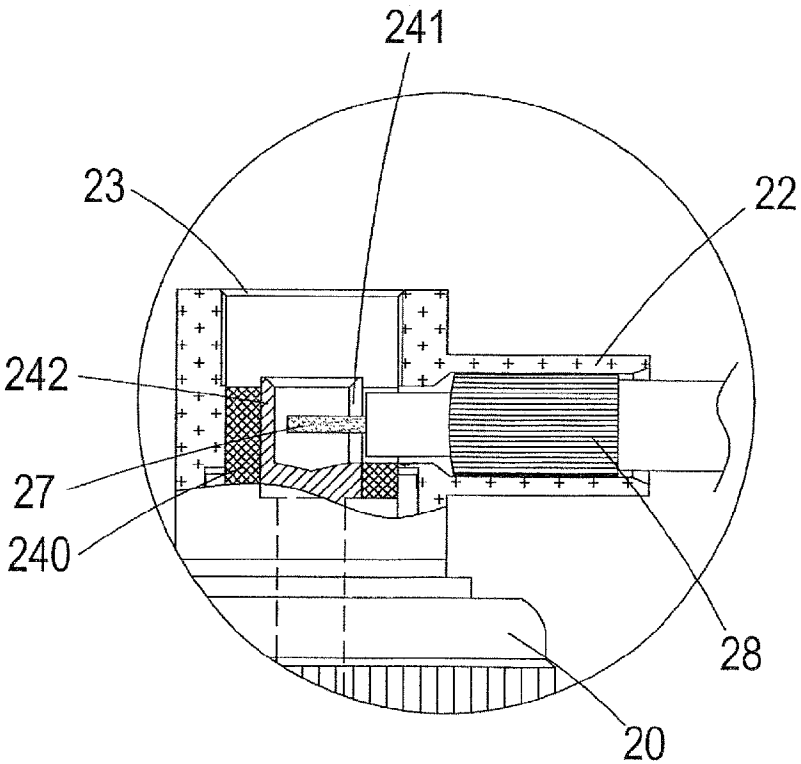
FIG. 5 is a cross-sectional view illustrating a second phase of assembling the coaxial cable connector according to the present invention.
Figure 6:
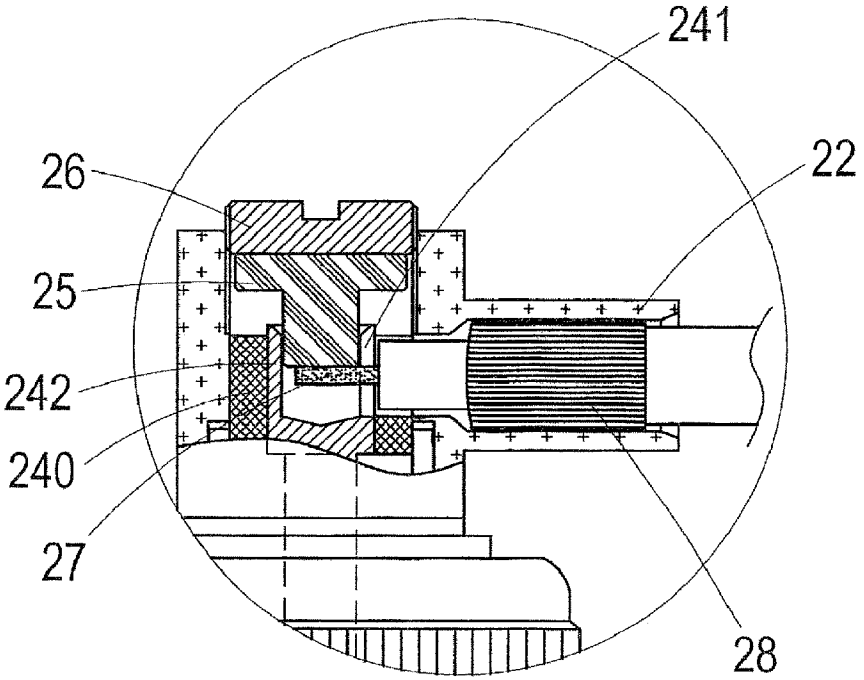
FIG. 6 is a cross-sectional view illustrating a third phase of assembling the coaxial cable connector according to the present invention.
Figure 7:
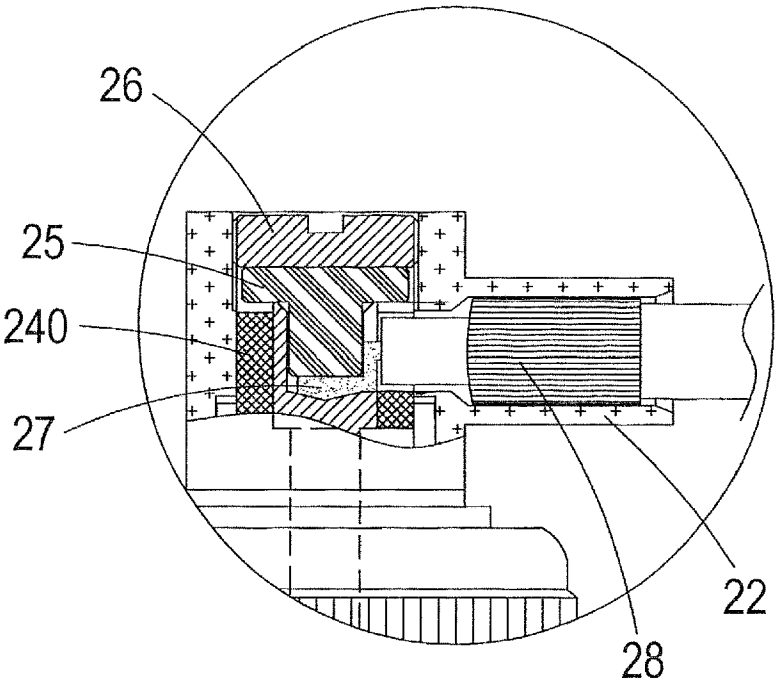
FIG. 7 is a cross-sectional view illustrating a fourth phase of assembling the coaxial cable connector according to the present invention.

Referring to FIGS. 2 and 3, which show an exploded view and a perspective view of a coaxial cable connector according to the present invention, as well as a coaxial cable jointed to the coaxial cable connector, as shown in the drawings, the coaxial cable connector of the present invention, which can be a right-angled connector, comprises a connector body 20, a contact chamber 21, a copper sleeve 22, and an observation window opening 23. Structurally, the connector body 20 forms therein the contact chamber 21 and the observation window opening 23 that is in communication with the contact chamber 21. The copper sleeve 22 is externally attached to a side wall of the contact chamber 21 to be in communication with an interior space of the contact chamber 21. A central contact bore 24 is defined inside the contact chamber 21 by a stop wall 242 in which a notch 241 is formed to correspond to the copper sleeve 22. An insulation layer 240 is arranged between the central contact bore 24 and an inside circumferential surface of the contact chamber 21. An insulation block 25 is provided to be received in the central contact bore 24. A window opening bolt 26 is provided to be received in and thus closes the observation window opening 23. With this arrangement, a coaxial cable connector according to the present invention is provided.

Referring to FIGS. 4-7, assembling of the coaxial cable connector and jointing a coaxial cable to the coaxial cable connector of the present invention is illustrated. The coaxial cable is first peeled to remove an outer insulation jacket and an intermediate insulation. An outer conductor 28 of the coaxial cable is folded back to lap on an adjacent un-removed section of the outer insulation jacket. A central contact bore 24 is then formed inside the observation window opening 23 and an insulation layer 240 is set between the observation window opening 23 and the central contact bore 24. The central contact bore 24 has a notch 241 formed in a side thereof close to the copper sleeve 22 to receive a core conductor 27 of the coaxial cable to insert therein. After the core conductor 27 and the outer conductor 28 are simultaneously inserted through the copper sleeve 22, the core conductor 27 is guided by opposing end edges of the insulation layer 240 to move through the notch 241 of the central contact bore 24. The stop wall 242 of the central contact bore 24 stops further movement of the core conductor 27 to prevent the core conductor 27 from going beyond the central contact bore 24, whereby the core conductor 27 is prevented from undesired contact with the contact chamber 21 to induce shorting. An insulation block 25 is then set to cover the central contact bore 24, and a window opening bolt 26 is set in engagement with the observation window opening 23 so as to close the observation window opening 23. When the window opening bolt 26 is tightened in a downward direction, a projection of the insulation block 25 is fit into the central contact bore 24 and depresses the core conductor 27 down to engage the central contact bore 24 for electrical contact therebetween. Finally, the copper sleeve 22 is processed to secure the outer conductor 28 therein. As such, the contact of the coaxial cable connector is completed.

It is noted that a preferred embodiment was described in detail to explain the principle of the present invention, yet such an embodiment is not intended to limit the true scope of the present invention and modifications and variations can be made on the basis the disclosure and illustrating given in the specification and the drawings, which are considered a part of the specification, without departing the scope of the present invention. All such modifications and variations show equivalent structures belong to the scope of the present invention defined in the appended claims.

The present invention so described above possesses advantages of which some are listed below:

(1) Electrical contact is completed by depression, which makes the assembling process simplified and operation time shortened.

(2) The electrical contact so formed by depression eliminates the potential risks associated with shorting and other electrical abnormality.

(3) The insulation block received in the central contact bore prevents the core conductor of a coaxial cable from contacting and thus electrically engaging the contact chamber and internal shorting can be prevented even though the window opening bolt that is tightened to the observation window opening block eyesight for visual inspection.

(4) The electrical contact is formed by depression so that no soldering iron is needed to perform soldering and product flaw rate can be reduced.

(5) Forming the electrical contact with depression allows for repairing and this helps reducing product flaw rate and thus cutting down manufacturing cost.

(6) An insulation layer is provided between the central contact bore 24 and the contact chamber and forms an opening delimited by opposing end edges that help leading in the core conductor a coaxial cable and protecting the core conductor from being split when the core conductor is inserted.

(7) The central contact bore is delimited by a surrounding stop wall in which a notch is defined so that when the core conductor is inserted through the notch into the central contact bore, the stop wall prevents undesired movement of the core conductor to penetrate beyond the central contact bore and further, an insulation block is provided to cover the central contact bore, whereby shorting will never occur.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A coaxial cable connector comprising a connector body, a contact chamber, a copper sleeve, and an observation window opening and characterized in that a central contact bore is formed inside the observation window opening and an insulation layer is set between the central contact bore and the contact chamber, the central contact bore having a notch formed in a side thereof close to the copper sleeve and a stop wall formed in an opposite side thereof, wherein the notch is adapted to receive a core conductor of a coaxial cable to insert therein and after the core conductor is inserted to extend through the insulation layer and moving into the central contact bore, the stop wall of the central contact bore prevents the core conductor from further moving beyond the central contact bore, an insulation block covering the central contact bore, a window opening bolt engaging and thus closing the observation window opening in order to force a projection of the insulation block to depresses the core conductor to engage the central contact bore for electrical contact therebetween, an outer conductor of the coaxial cable being received and retained in the copper sleeve.

2. The coaxial cable connector according to claim 1, wherein the connector comprise a right-angled connector.

3. The coaxial cable connector according to claim 1, wherein the coaxial cable is received in the copper sleeve in such a way that the outer conductor of the coaxial cable is folded back and overlapping an adjacent section of an outer insulation jacket of the coaxial cable.

4. The coaxial cable connector according to claim 1, wherein the coaxial cable is jointed to the coaxial cable connector in such a way a pin-like portion of the core conductor of the coaxial cable is received in and engages with the central contact bore of the connector.

* * * * *